US008290408B2

(12) United States Patent
Lean et al.

(10) Patent No.: US 8,290,408 B2
(45) Date of Patent: Oct. 16, 2012

(54) METHOD AND SYSTEM FOR NON-CONTACT POWDER IMAGE DEVELOPMENT

(75) Inventors: Meng H. Lean, Santa Clara, CA (US); Shu Chang, Pittsford, NY (US); Daniel L. Larner, San Jose, CA (US); Armin R. Volkel, Mountain View, CA (US)

(73) Assignees: Xerox Corporation, Norwalk, CT (US); Palo Alto Research Center Incorporated, Palo Alto, CA (US)

( * ) Notice: Subject to any disclaimer, the term of this patent is extended or adjusted under 35 U.S.C. 154(b) by 427 days.

(21) Appl. No.: 12/049,013

(22) Filed: Mar. 14, 2008

(65) Prior Publication Data

US 2009/0232561 A1 Sep. 17, 2009

(51) Int. Cl.
*G03G 15/08* (2006.01)
*G03G 15/06* (2006.01)

(52) U.S. Cl. ..... 399/266; 399/55

(58) Field of Classification Search ..... 399/55, 399/291, 290, 266; 347/55
See application file for complete search history.

(56) References Cited

U.S. PATENT DOCUMENTS

| | | | | |
|---|---|---|---|---|
| 5,453,768 | A * | 9/1995 | Schmidlin | 347/55 |
| 5,678,130 | A | 10/1997 | Enomoto et al. | |
| 6,026,264 | A | 2/2000 | Wong et al. | |
| 6,035,170 | A | 3/2000 | Snelling | |
| 6,198,886 | B1 * | 3/2001 | Brewington | 399/49 |
| 6,223,013 | B1 | 4/2001 | Eklund et al. | |
| 6,360,067 | B1 | 3/2002 | Hays et al. | |
| 6,459,862 | B1 | 10/2002 | Sakemi et al. | |
| 7,079,794 | B2 | 7/2006 | Forbes, II et al. | |
| 7,580,648 | B2 * | 8/2009 | Shaw et al. | 399/55 |
| 2004/0253014 | A1 * | 12/2004 | Bares | 399/49 |

* cited by examiner

*Primary Examiner* — David Porta
*Assistant Examiner* — Yara Green
(74) *Attorney, Agent, or Firm* — Fay Sharpe LLP

(57) ABSTRACT

An improved method and system for non-contact powder image development are provided. The present technique implements a 5-stage jumping development cycle where the initial stage is a momentary over-voltage condition to release the majority of the toner on a donor substrate and the final stage includes the implementation of a decelerating potential to minimize return impact on the donor and therefore toner abuse. It also uses a routine to directly determine improved (e.g. up to optimal) waveform amplitudes and pulse widths based on toner size and q/m, guided by physical insight.

17 Claims, 7 Drawing Sheets

METHOD AND SYSTEM FOR NON-CONTACT POWDER IMAGE DEVELOPMENT

BACKGROUND

For image-on-image (IOI) electrographic imaging, it is desirable and perhaps even necessary to have scavenge-less development subsystems that will not disturb existing images on the photoreceptor. In known systems, this is accomplished by using wire-based development systems such as Hybrid Scavenge-less Development (HSD), where one or more fine metallic wires (e.g., sliding on donor surfaces) are used to introduce toner into the development NIP as a powder cloud. This introduction of toner as a suspended cloud is referred to as fluidization. Unfortunately, the wires quickly become contaminated with particulate matter comprising unmodified and modified toner (e.g., crushed and pressured-fused toner sometimes known as "corn flakes") and related flow and charge-control agents. This material is capable of trapping charge and modulating the local electric field near the surface of the wire. This uncontrolled charge introduces undesirable artifacts into the image developed on the photoreceptor. The typical solution to this problem is to frequently replace the wires. This leads to unacceptable downtime of the product, unsatisfied customers, high maintenance costs, and a significant loss of revenue.

Other methods of toner fluidization include DC and AC jumping and hybrid jumping development (HJD) All of these approaches, however, suffer from shortcomings that are manifested in developed image artifacts. A better approach is needed to fluidize the toner and develop images uniformly with a minimum of background.

A wireless method for toner fluidization to achieve 101 (image-on-image) development is also known and described in U.S. application Ser. No. 11/691,834, filed Mar. 27, 2007, and entitled "Systems and Methods for Momentum Controlled Scavengeless Jumping Development in Electrophotographic Marking Devices," which application is incorporated herein by reference in its entirety. This previous method provides a technique to modulate the potential applied across the nip region in such a way as to allow development to occur on the photoreceptor, driven by the latent charge image, with undue scavenging action. In this technique, the period of the conventional jumping development cycle is divided into four stages to achieve the sequential effects of injection (dislodging the toner from the donor's surface and injecting it into the nip region), momentum control (decelerate the toner particles while they are still in flight), drift (allow low-speed toner particles to hang in space near the receiver), and reset (encouraging undeveloped toner in the cloud to migrate back towards the donor).

INCORPORATION BY REFERENCE

U.S. application Ser. No. 11/691,834, filed Mar. 27, 2007 (Xerox Docket No. 20061442-US-NP), and entitled "Systems and Methods for Momentum Controlled Scavengeless Jumping Development in Electrophotographic Marking Devices," is incorporated herein by reference in its entirety

BRIEF DESCRIPTION

In one aspect of the presently described embodiments, a method comprises steps of ejecting toner particles from the donor surface using an overvoltage condition, accelerating the ejected toner particles toward the receiver surface, decelerating the ejected toner particles as the ejected toner particles approach the receiver surface returning undeveloped toner particles to the donor surface, and, decelerating undeveloped toner particles as the undeveloped toner particles approach the donor surface.

In another aspect of the presently described embodiments, the ejecting, accelerating, decelerating, returning and decelerating are controlled by a controller operative to produce and output waveform based on selected input parameters.

In another aspect of the presently described embodiments, the overvoltage condition is momentary.

In another aspect of the presently described embodiments, overvoltage condition results in releasing a majority of the toner particles from the donor surface.

In another aspect of the presently described embodiments, the overvoltage condition is sufficient to overcome adhesion forces between the toner particles and the donor surface.

In another aspect of the presently described embodiments, the overvoltage condition is tuned based on a desired value for the accelerating step.

In another aspect of the presently described embodiments, the decelerating step minimizes impact of the undeveloped particles on the donor surface.

In another aspect of the presently described embodiments, the receiver surface is a photoreceptor.

In another aspect of the presently described embodiments, the method further comprises providing a reverse background bias.

In another aspect of the presently described embodiments, a system comprises a donor surface having toner particles disposed thereon, a receiver surface operative to receive the toner particles, and, a controller operative to produce signals to control migration of the toner particles from the donor surface to the receiver surface wherein the donor particles are ejected from the donor surface using an overvoltage condition, accelerated toward the receiver surface and decelerated as the ejected particles approach the receiver surface and further wherein undeveloped toner particles are returned to the donor surface and decelerated as the undeveloped toner particles approach the donor surface.

In another aspect of the presently described embodiments, the controller is operative to receive input signals.

In another aspect of the presently described embodiments, the input signals comprise q/m, d, p.

In another aspect of the presently described embodiments, the signals comprise a waveform.

In another aspect of the presently described embodiments, the system further comprises a function generator operative to receive the waveform and produce signals to be output to a voltage amplifier.

In another aspect of the presently described embodiments, the system further comprises a microscope operative to capture images on the receiver surface.

In another aspect of the presently described embodiments, the microscope provides feedback to the controller.

In another aspect of the presently described embodiments, the receiver surface is a photoreceptor.

DETAILED DESCRIPTION

The presently described embodiments improve upon the prior noted wireless method(s) in at least the following respects: (1) a 5-stage jumping development cycle is implemented where the initial stage is a momentary over-voltage condition to release the majority of the toner on a donor substrate and the final stage includes the implementation of a decelerating potential to minimize the return impact on the donor and, therefore, toner abuse; and (2) a routine is used to directly determine improved (e.g. up to optimal) waveform amplitudes and pulse widths based on toner size and q/m, guided by physical insight. In at least one form, the routine allows for an automation of the process.

In this regard, given a distribution of particle size and charge, detachment forces have to act over a wide range to overcome the nonlinear adhesion forces of the donor surface to fluidize particles. The contemplated momentary overvoltage serves to so detach the majority of particles with a high Coulomb force—but also stay below the threshold for air breakdown. Air breakdown can result in undesired sparking or ionization. This over-voltage can be achieved, in one form, using high voltage (HV) amplifiers with high slew rate and wide small signal bandwidth. In one form, the momentary over-voltage has an amplitude of approximately 4.5 volts-per-micrometer and a duration of 50 microseconds or less.

Moreover, a routine, based on single particle dynamics, is derived for direct determination of the momentum control (MC) waveform amplitudes and pulse widths to satisfy the prescribed operational conditions. The particles are fluidized with an initial momentary over-voltage. The notion is to separate the dynamics of moving particles from the bottom to the top plate within a gap (as will be described in connection with FIG. 1) into five contiguous operations (as will be described in connection with FIGS. 2 and 3). Each stage is controlled by an electric field strength applied over a pulse interval.

Figure 1:
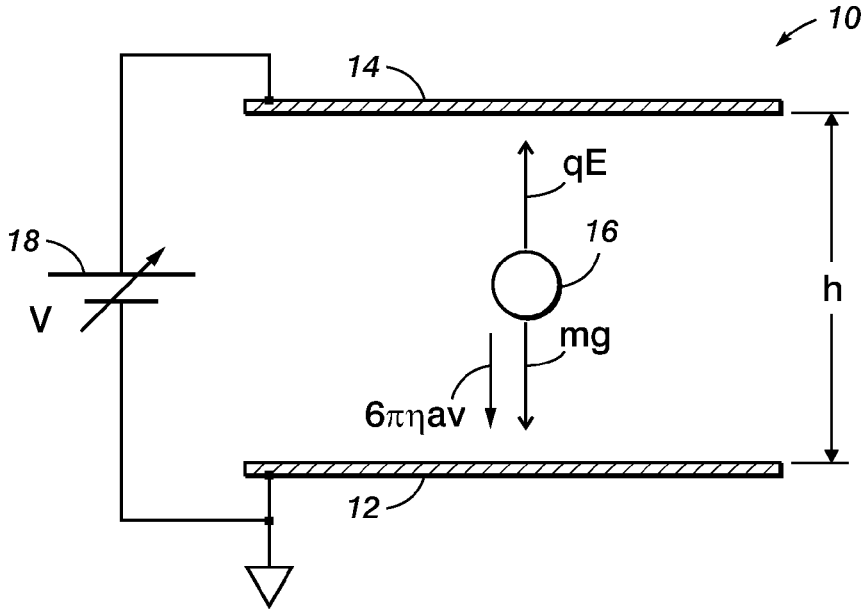
FIG. 1 illustrates an environment in which the presently described embodiments may be implemented.

With reference to FIG. 1, a representative environment into which the presently described embodiments may be implemented is illustrated. As shown, a partial image rendering system 10 includes a donor surface 12 and a receiver surface 14. A toner particle 16 may migrate under Coulomb force, qE, from the donor surface 12 to the receiver surface 14 according to the presently described embodiments under the control of a voltage source 18, creating a field, E, between the donor and receiver surfaces 12 and 14. Other forces acting on the toner particle 16 include air drag ($6\pi\eta av$) and gravity mg. It should also be appreciated that a gap h exists between the donor surface 12 and the receiver surface 14.

To further explain, the migration of a spherical particle in an air gap between two parallel plates is shown in FIG. 1. The Newtonian equation of motion is:

$$mdv/dt=qE-mg-6\pi\eta av \tag{1}$$

where m, q, a, and v are respectively, the mass, charge, radius, and velocity of the particle; η is the viscosity of air; and E is the electric field. The general solution for this first order ODE is:

$$v(t)=(a-Ae^{-bt})/b \tag{2}$$

with

| | |
|---|---|
| $a = qE/m - g$ | $b = 6\pi\eta\ a/m$ |

Particular solutions for particle displacement, velocity, and acceleration for the momentum control (MC) application with the five phases i=1, 2, 3, 4, 5 are as follows:

$$\begin{aligned} x_i(t)&=(a_i/b)t+(A_i/b^2)e^{-bt}+C_i \\ v_i(t)&=a_i/b-(A_i/b)e^{-bt} \\ a_i(t)&=A_ie^{-bt} \end{aligned} \tag{3}$$

where $0<t<T_i$. $A_i$ and $C_i$ are coefficients given by:

| | |
|---|---|
| $A_1 = a_1$ | $C_1 = -A_1/b^2$ |
| $A_2 = a_2 - bv_1(T_1)$ | $C_2 = x_1(T_1) - A_2/b^2$ |
| $A_3 = a_3 - bv_2(T_2)$ | $C_3 = x_2(T_2) - A_3/b^2$ |
| $A_4 = a_4 - bv_3(T_3)$ | $C_4 = x_3(T_3) - A_4/b^2$ |
| $A_5 = a_5 - bv_4(T_4)$ | $C_5 = x_4(T_4) - A_5/b^2$ |

It should be understood that the system 10 may take a variety of different forms in a variety of different environments. For example, the donor surface 12 may take the form of a donor roll that is populated with toner particles as it is rotated through a supply of toner material. Multiple rolls such as donor rolls and mag rolls may also be used. Likewise, the receiver surface 14 may take the form of a photoconductive belt upon which an image is formed for suitable rendering. The voltage source 18 could also take a variety of forms that are suited to the particular environment of implementation. In one form, an example of which will be hereafter described in more detail in connection with FIG. 7, the voltage source is a high voltage amplifier that is controlled by a waveform signal generated in accordance with the presently described embodiments. It should also be appreciated that only a single toner particle is illustrated for ease of explanation; however, those of skill in the art will clearly understand that the typical environment of implementation involves a plurality of toner particles migrating from a donor surface to a receiver surface.

Figure 2:
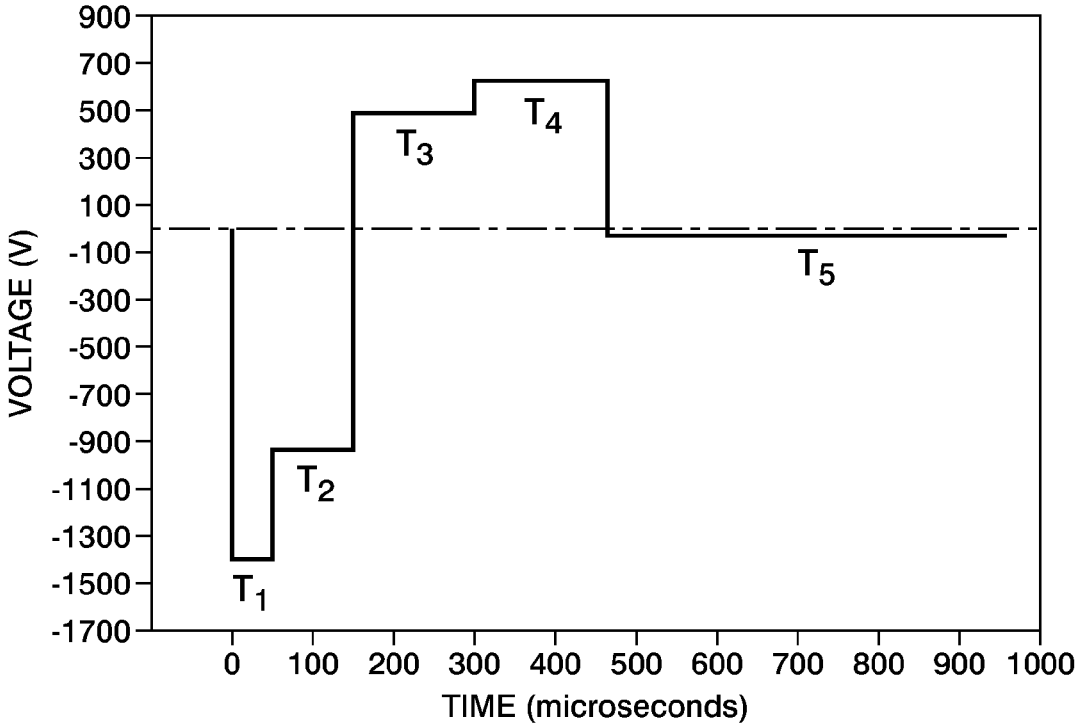
FIG. 2 illustrates a waveform according to the presently described embodiments.

So, with reference to FIG. 2, according to the presently described embodiments, five stages or contiguous operations to migrate an appropriate amount of toner from a donor surface to a receiver surface are provided. These stages include:

Ejecting particles from a donor surface to a receiver surface using a momentary high E field and pulse width pair $[E_1,T_1]$;

Accelerating particles toward the receiver surface with a lower E field pair $[E_2,T_2]$;

Decelerating particles to prevent premature impact onto the receiver surface or top plate using $[E_3,T_3]$ (drift of the particles may occur under the influence of image fields while the particles crest at the top of the cloud);

Resetting or returning undeveloped particles back to the donor surface or bottom plate using $[E_4,T_4]$; and Decelerating or retarding particles to minimize impact on the donor surface using $[E_5,T_5]$, where $T=T_1+T_2+T_3+T_4+T_5$ is the period of the momentum control (MC) cycle with frequency f=1/T. The $[E_i,T_i]$ pairs are determined in order beginning from i=1.

The equations described in connection with FIG. 1 provide sufficient relationships to directly determine the set of $[E_i,T_i]$; i=1, 2, 3, 4, 5 to satisfy operational conditions.

With continuing reference to FIG. 2, the sequential procedure or routine to determine the five sets of field and pulse width pairs, $[E_i,T_i]$, are performed in their order of operation.

$[E_1,T_1]$—A displacement distance of $h_1=x_1(T_1)<h$, the gap height, may be prescribed as the elevation to which the particles must attain during initial ejection. Applying the initial condition that the particle starts from rest at the bottom of the plate (or on the donor surface), a relation is derived:

$$a_1=x_1(T_1)/[T_1/b+(\exp(-bT_1)-1)/b^2]=qE_1/m-g \quad (4)$$

which allows $E_1$ to be derived in terms of $T_1$. An infinite set of $[E_1,T_1]$ exist which satisfy this displacement requirement. An appropriate pair of $[E_1,T_1]$ may be selected based on several criteria, including: (1) an appropriately high E field to overcome adhesion forces in the form of image and van der Waal forces; and (2) a moderately low velocity at the $x_1(T_1)$ elevation so that a smaller field can be use for particle retardation in the next step.

[E2,T2]—A displacement condition may be prescribed where $x_1(T_1)<x_2(T_2)<h$, and $h_2=x_2(T_2)$ represents the elevation at which the particle begins to be slowed or retarded. The relation is derived as:

$$a_2=[x_2(T_2)-x_1(T_1)+v_1(T_1)(\exp(-bT_2)-1)/b]/[T_2/b+(\exp(-bT_2)-1)/b^2]=qE_2/m-g \quad (5)$$

which allows $E_2$ to be derived in terms of $T_2$. An infinite set of $[E_2,T_2]$ exist which satisfy this displacement requirement. An appropriate pair of $[E_2,T_2]$ may be selected which does not lead to air breakdown conforming to similar criteria as in the previous stage.

$[E_3,T_3]$—A displacement condition may be prescribed where $x_1(T_1)<x_2(T_2)<x_3(T_3)<h$, and $h_3=x_3(T_3)$ represents the elevation at which the particle is slowed or retarded to zero velocity, or $v_3(T_3)=0$. The relation is derived as:

$$a_3=-bv_2(T_2)\exp(-bT_3)/(1-\exp(-bT_3))=qE_3/m-g \quad (6)$$

which allows $E_3$ to be derived in terms of $T_3$. There is only one unique solution that satisfies the displacement condition at $x_3(T_3)$. The pair of $[E_3,T_3]$ corresponding to this displacement is selected.

$[E_4,T_4]$—Undeveloped particles from the vicinity of the top plate are returned to the bottom plate with the following condition:

$$a_4=[x_4(T_4)-x_3(T_3)+v_4(0)(\exp(-bT_4)-1)/b]/[T_4/b+(\exp(-bT_4)-1)/b^2]=qE_4/m-g \quad (7)$$

where $v_4(0)=v_3(T_3)$. An infinite set of $[E_4,T_4]$ exist which satisfy this displacement requirement, and the particular value is selected so that a smaller field can be use for particle retardation in the next step.

$[E_5,T_5]$—A displacement condition is prescribed where $x_5(T_5)=0$, which represents the bottom plate at which the particle is slowed or retarded to zero velocity, or $v_5(T_5)=0$. The relation is given as:

$$a_5=-bv_4(T_4)\exp(-bT_5)/(1-\exp(-bT_5))=qE_5/m-g \quad (8)$$

which allows $E_5$ to be derived in terms of $T_5$. There is only one unique solution that satisfies the displacement condition at $x_5(T_5)$. The pair of $[E_5,T_5]$ corresponding to this displacement is selected.

Figure 3:
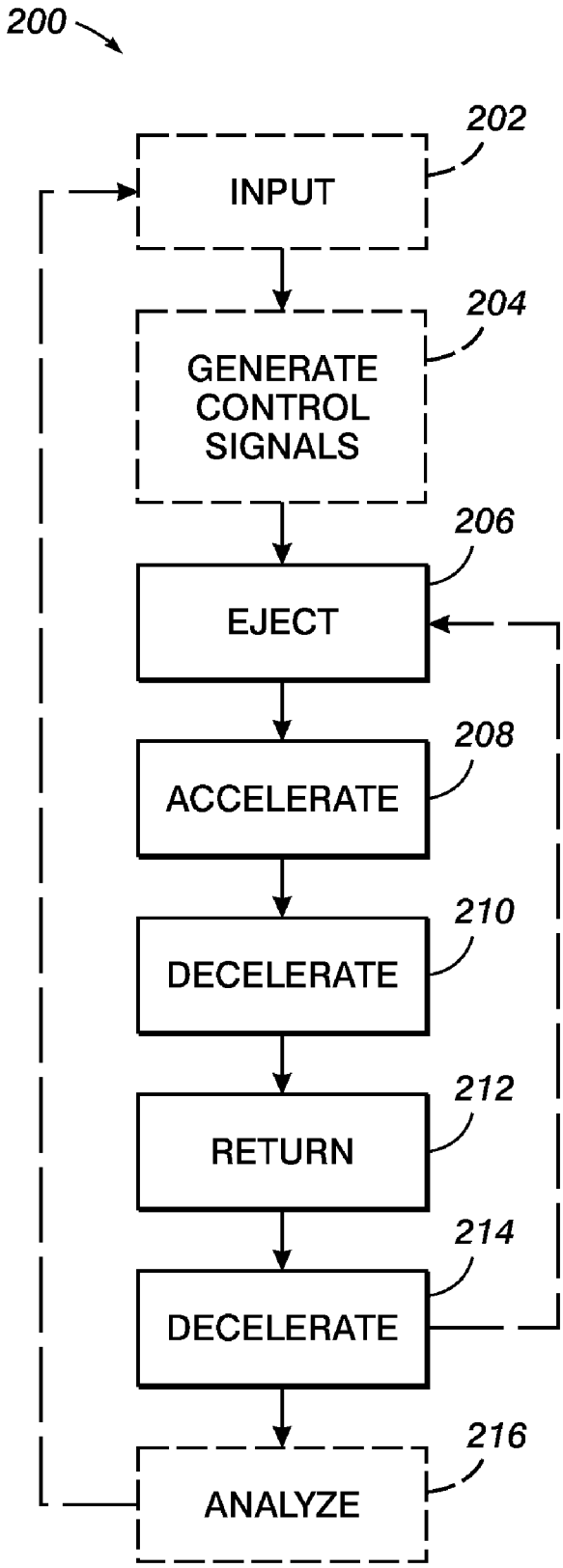
FIG. 3 is a flow chart illustrating a method according to the presently described embodiments.

With reference to FIG. 3, a method 200 for migrating a suitable amount of toner from a donor surface to a receiver surface is illustrated. The method could be implemented using a variety of software routines and/or hardware configurations, examples of which are described herein in connection with the figures, for example, FIGS. 1, 2, 3 and 7. The method 200 includes receiving input from an appropriate source to define parameters (examples of which will be described in connection with FIG. 7) (at 202). For example, the parameters may be based on particle characteristics, system characteristics and/or control characteristics. Control signals are then generated to control the system (at 204). The control signals could take a variety of forms, including waveforms. It should be understood that the input parameters and generation of control signals could be realized in a variety of implementations. In one form, the system is automated and, once initialized, uses feedback to generate dynamic control signals that are responsive to changes in the environment. In other forms, the input and generation are predetermined and/or implemented manually. Of course, combinations of automated and predetermined/manual approaches may be used.

Notwithstanding these differing manners of obtaining control signals, the toner particles are ejected from the donor surface using an overvoltage condition (at 206). The overvoltage condition is momentary but results in releasing a majority of the toner particles from the donor surface. Also, the overvoltage condition is sufficient to overcome adhesion forces between the toner particles and the donor surface and is tuned based on a desired value for subsequent accelerating. Then, the particles are accelerated toward the receiver surface (at 208). To reduce impact on the receiver surface, the toner particles are then decelerated as the ejected toner particles approach the receiver surface (at 210). It will be appreciated that, at this point, many of the toner particles will attach to the receiver surface, or develop. Of course, not all toner particles will do so. As a result, undeveloped toner particles are returned to the donor surface (at 212). Then, the undeveloped toner particles are decelerated as the undeveloped toner particles approach the donor surface (at 214). This reduces the impact of the particles on the donor surface and prevents particle abuse conditions.

As noted above, in some forms, the method may utilize feedback techniques. So, the image on the receiver surface may be analyzed (at 216) to provide useful feedback for the purpose of enhancing the process of generating control signals or waveforms.

Sample Calculation

Figure 4A:
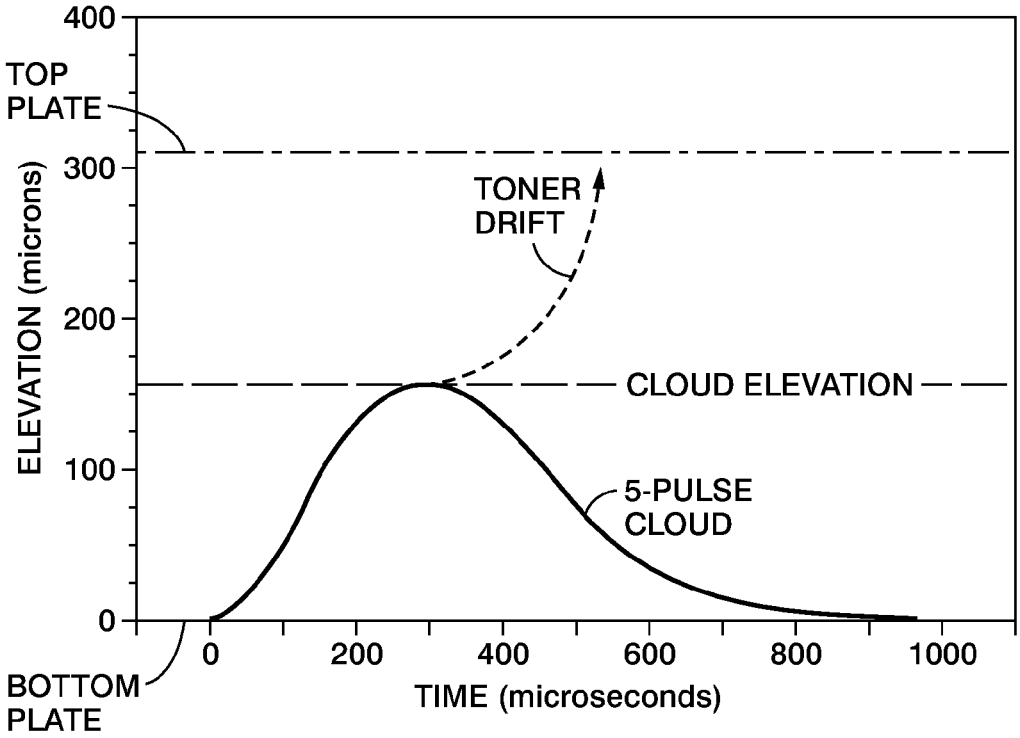
FIGS. 4(*a*) and 4(*b*) illustrate toner trajectory and toner velocity according to the presently described embodiments.
Figure 4B:
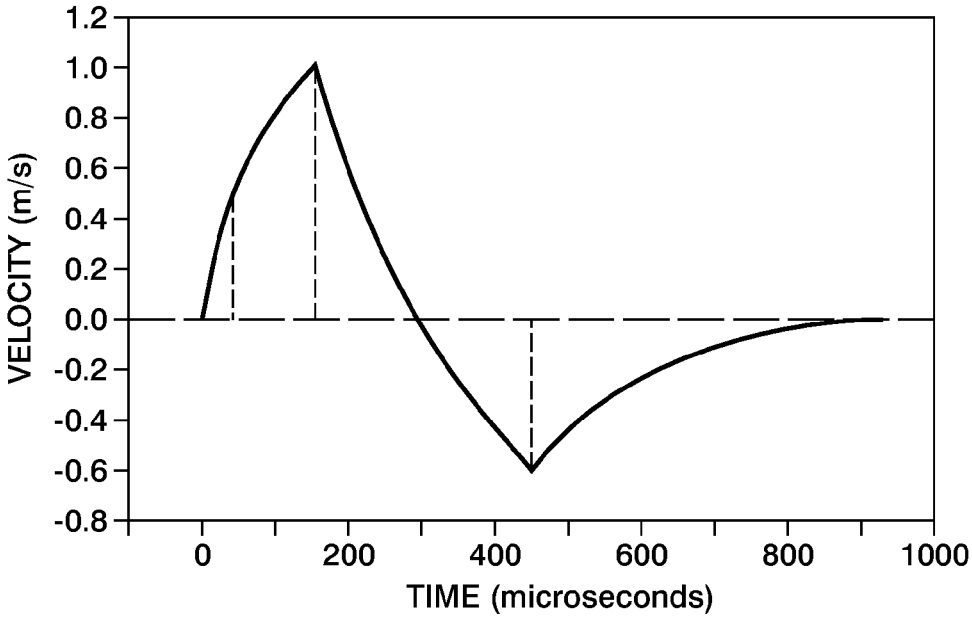

A sample dynamic calculation for 8 μm particles with q/m of −20 μC/gm is performed using the following pairs of waveform amplitude and pulse widths which were determined by the algorithm described above with $h_1=0.05h$, $h_2=0.3h$, $h_3=0.5h$, $h_4=0.3h$, $h_5=0$. The corresponding particle trajectory and velocity within the nip are shown in FIGS. 4(*a*) and 4(*b*).

Figure 5:
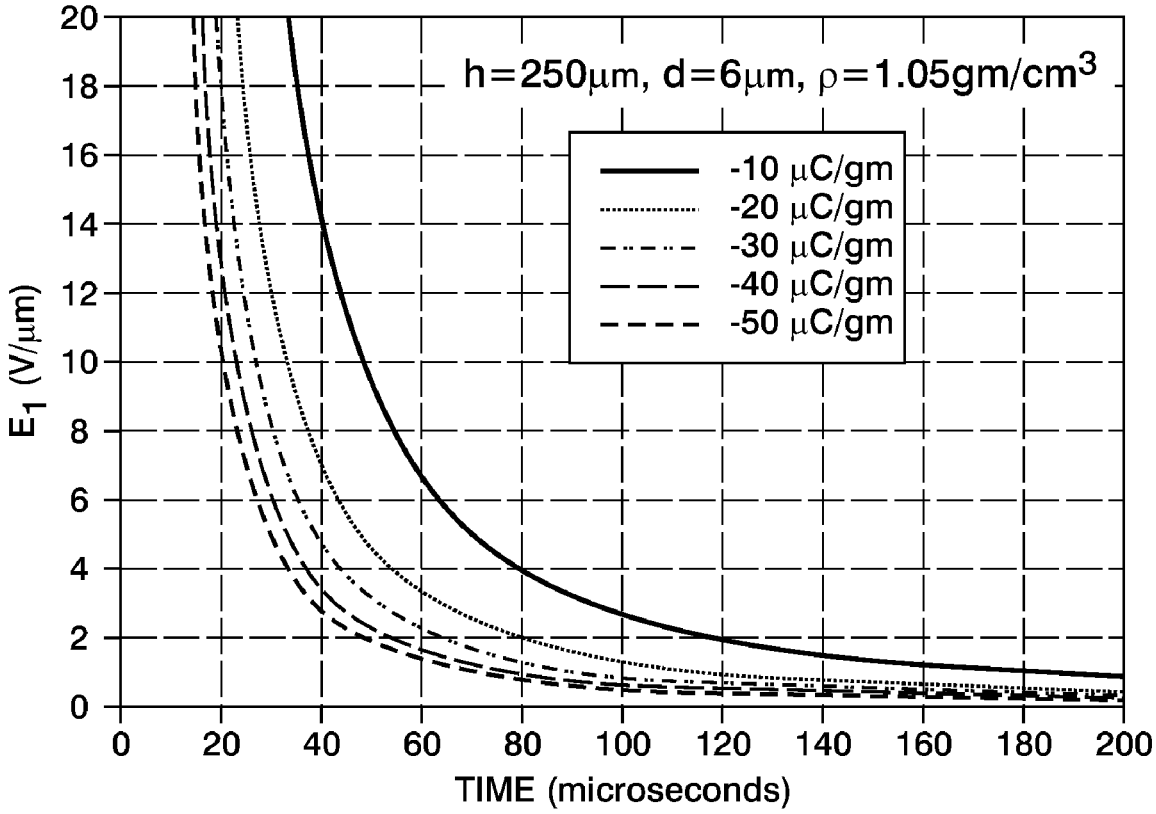
FIG. 5 illustrates a graph showing selection of data according to the presently described embodiments.

The presently described embodiments provide a direct method to select $[E_i,T_i]$ pairs once operational conditions are selected, thus eliminating any guesswork. The procedure may be repeated to perform tolerance studies on a range of particle sizes or q/m ratios. FIG. 5 shows a family of curves for a range of q/m values for a 250 μm gap (h), 6 μm particle size (d), and $\rho=1.05$ gm/cm$^3$ (material density). As shown, an ejection E field is to move a 6 μm particle to 100 μm elevation within the pulse width. The various q/m ratios are shown in the inset box ranging from −10 to −50.

TABLE 1

Sample $[E_i, T_i]$ pairs.

| Time | Remark |
|---|---|
| $T_1$ | Time to $h_1$ w/ $E_1$ = −4.5 V/μm |
| $T_2$ | Time to $h_2$ w/ $E_2$ = −3.0 V/μm |
| $T_3$ | Time to $h_3$ w/ $v_3$ = 0 m/s |
| $T_4$ | Time to $h_4$ w/ $E_4$ = +2.0 V/μm |
| $T_5$ | Time to $h_5$(=0) w/ $v_5$ = 0 m/s |

It should be pointed out that an excessively high charge results in high image forces (which are proportional to $q^2$) that make it difficult to detach toner from a substrate. Correspondingly, excessively high E fields cause high polarization forces (which are proportional to $E^2$) that also make it difficult to detach the particles. In this regard, it should be appreciated that, in order for a particle to detach, the force of the charge on the particle ($F_{coulomb}$) should be greater than the sum of van der Waal forces ($F_{vdw}$), image forces ($F_{image}$) and polarization forces ($F_{polarization}$). So, $$F_{coulomb} \geq F_{vdW} + F_{image} + F_{polarization}$$

where $F_{image} = q^2/4\pi\epsilon_o d^2$ $F_{polarization} = \pi\epsilon_o d^2 E^2$ $F_{coulomb} = qE$ where q is charge, d is toner particle diameter, E is electric field and $\epsilon_0$ is the dielectric permittivity of free space.

Figure 6A:
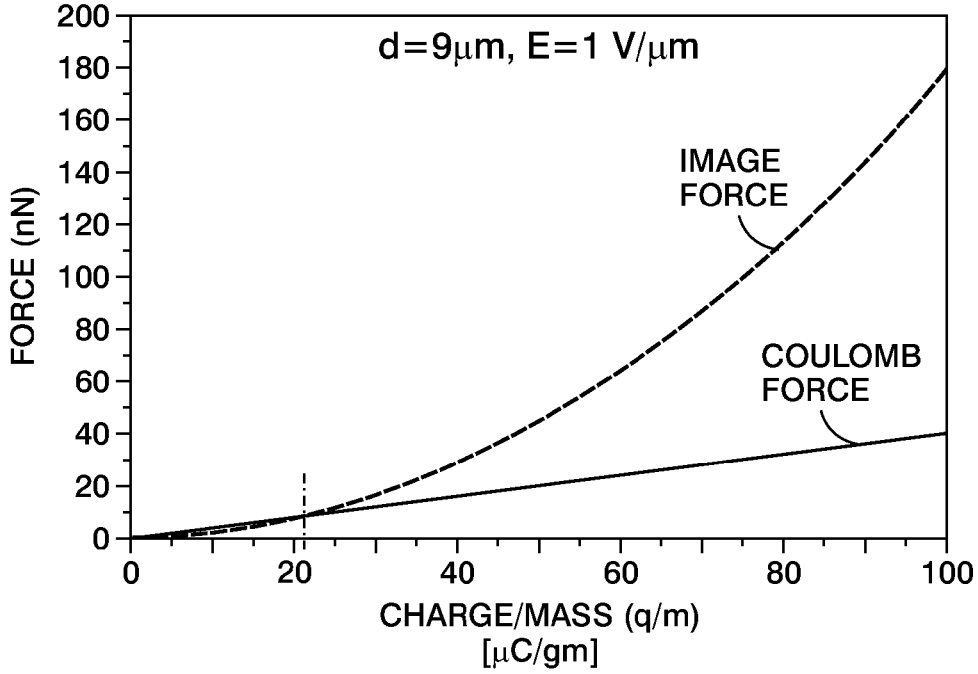
FIGS. 6(*a*) and 6(*b*) are graphs illustrating forces on particles.
Figure 6B:
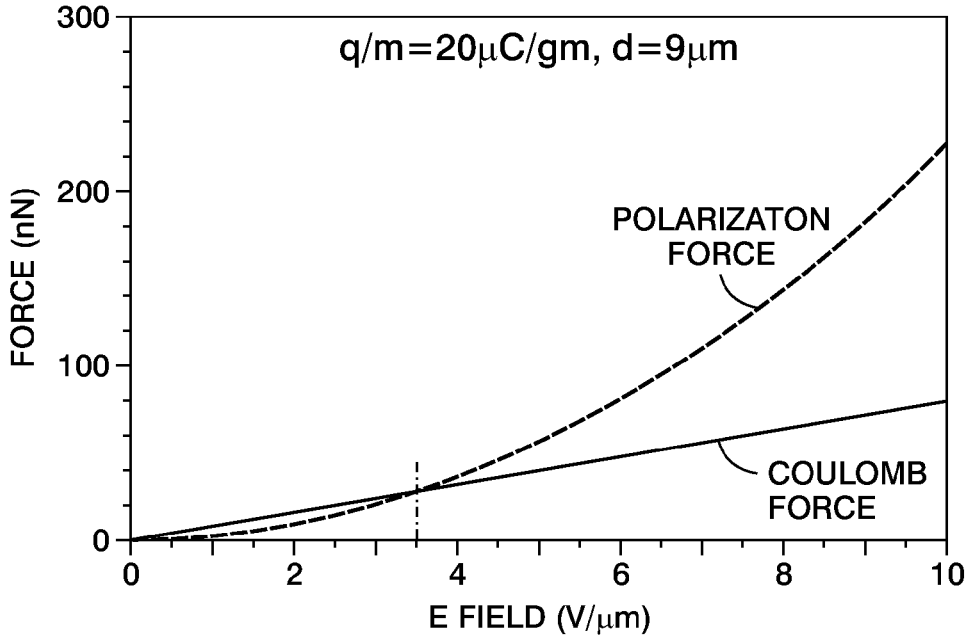

FIGS. 6(*a*) and 6(*b*) show the corresponding variation of the image and polarization forces. As shown, it should be appreciated that the values for q and E should be selected as a compromise between these extremes. As examples, the q/m ratio should stay below 25 or so for the image force not to dominate and the field should stay below approximately 4-5 V/μm for the polarization force not to dominate.

Figure 7:
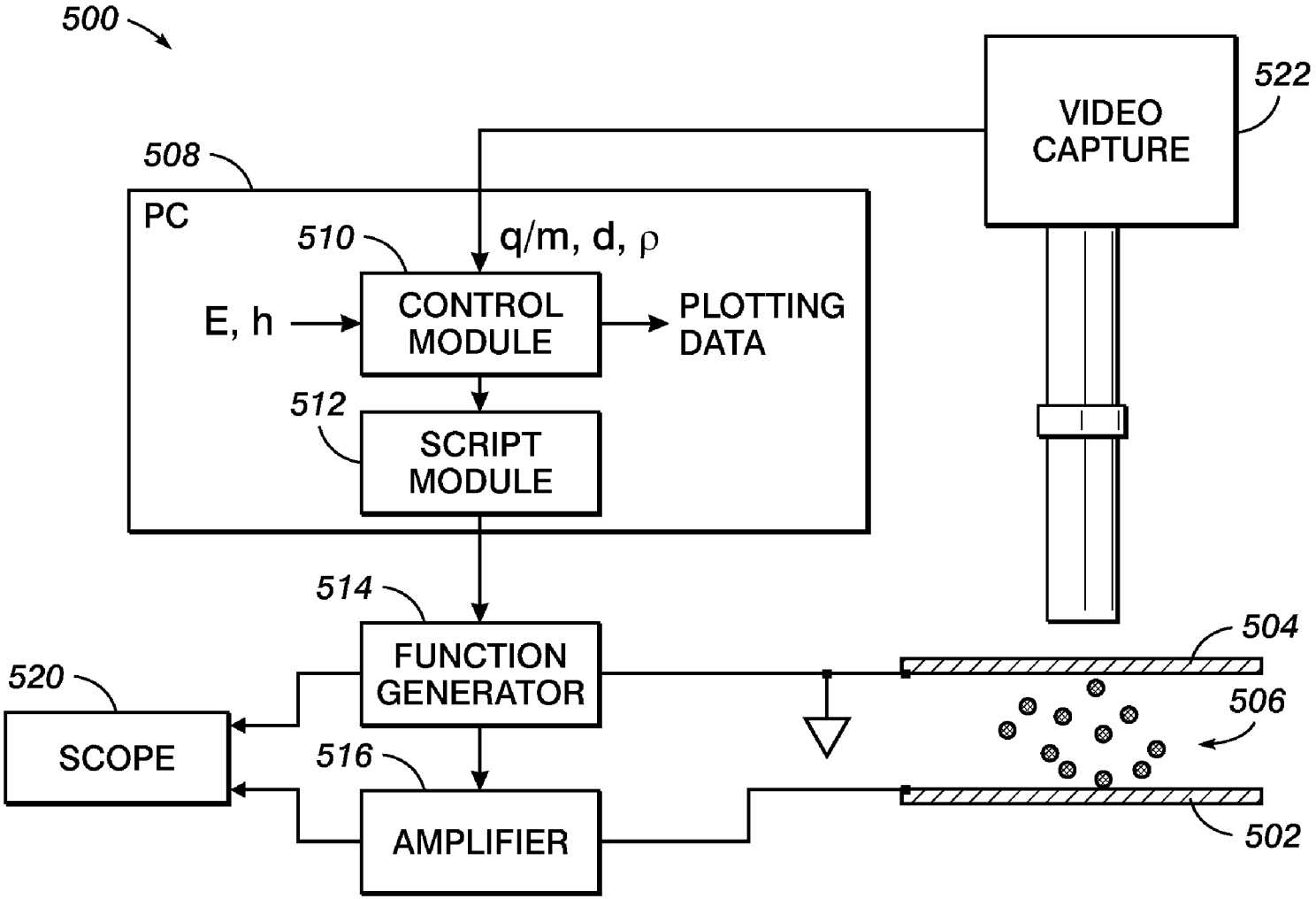
FIG. 7 illustrates a system according to the presently described embodiments.

An implementation of the presently described embodiments is shown in FIG. 7. As illustrated, a system 500 includes a donor surface 502 and a receiver surface 504 having toner particles 506 migrate there between. Also shown is a controller 508 having a control module 510 for running the routines contemplated herein. A script module 512 is also shown. The script module 512 converts the output of the control module 510 into a suitable format for further processing and implementation. In this regard, a programmable function generator 514 is positioned to receive the output of module 512 and provides suitable output signals to a high voltage amplifier 516. As noted above, the high voltage amplifier controls the field or potential between the donor and receiver surfaces according to the presently described embodiments.

Also shown in FIG. 7 are a scope 520 and an image analysis system 522. These components may be used to facilitate analysis or provide feedback to the controller to enhance the process, as noted above.

In operation, the controller 508 produces signals to control migration of the toner particles 506 from the donor surface 502 to the receiver surface 504. These signals are generated based on input parameters which include input signals such as q/m, d, ρ, where q is charge, m is mass, d is particle diameter and p is material density. These parameters relate to toner particle characteristics. In addition, the parameters E and h relate to system or control characteristics and represent, in one form, $E_1$, $E_3$, $h_1$, $h_2$ and $h_3$. These five parameters are input and/or selected, as will be understood from the description in connection with FIG. 2 (as well as FIGS. 1 and 3). The toner particles are then ejected from the donor surface 502 using an overvoltage condition, accelerated toward the receiver surface 504 and decelerated as the ejected particles approach the receiver surface 504. Undeveloped toner particles are returned to the donor surface 502 and decelerated as the undeveloped toner particles approach the donor surface 502.

The system of FIG. 7 may run an example sequence as follows:

Load toner onto the donor surface in any of a variety of known manners;

Create charge image on the receiver surface as is well known in the field;

Run the controller 508 using input toner data (as shown) to generate control signals such as momentum control (MC) waveforms and toner particle trajectory as output;

Load waveform into the programmable function generator 514;

Run high voltage amplifier 516 according to the method as described, for example in FIG. 3; and Visualize, grab frames and videos, use microscopy, and/or take snap shots using the system(s) 520 and/or 522 for use in providing analysis or feedback, for example.

Figure 8:
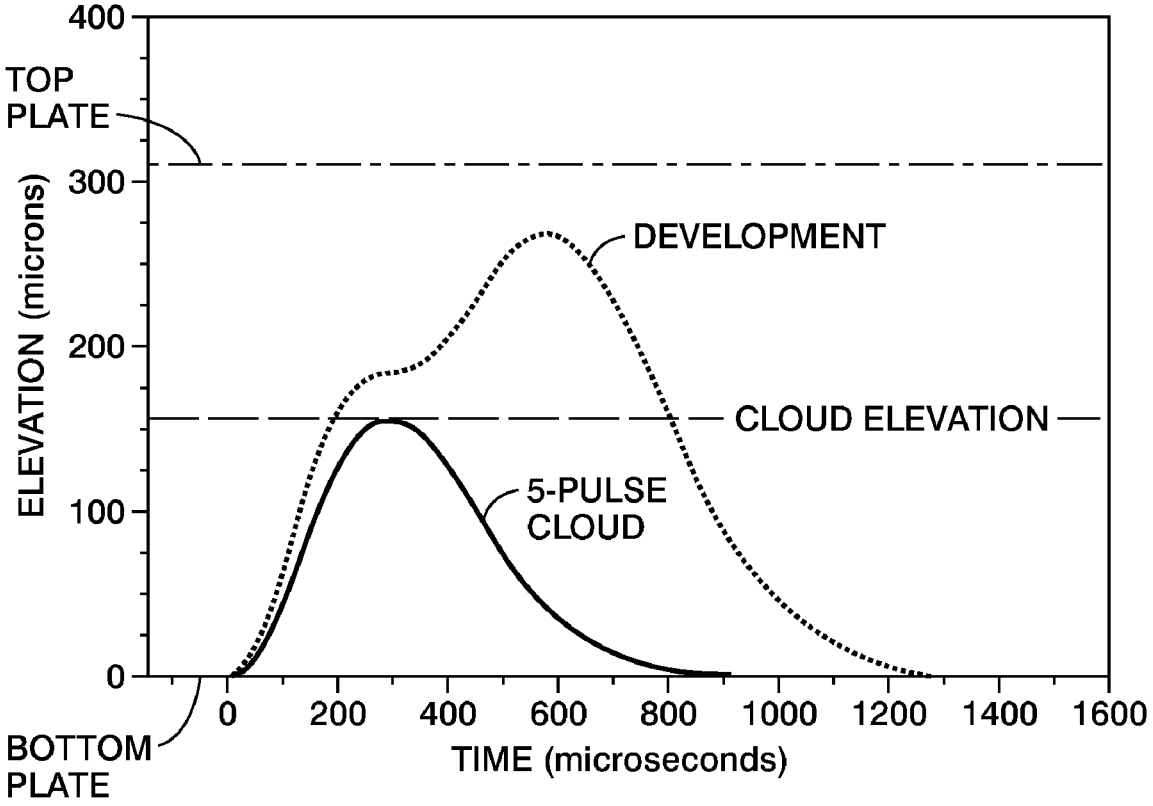
FIG. 8 is a graph showing toner trajectory according to the presently described embodiments.

FIG. 8 shows two computed particle trajectories for the cases where the particle cloud does not develop on the top plate when the elevation is 0.5h, and when the particle develops an image at a higher elevation of 0.8h where the imaging field reaches down from the top receiver to selectively pull toner for development. This may not be desired.

It should be appreciated that such undesired background development of toner particles can present difficulties in image quality in selected cases. So, application of a reverse bias in the receiver surface may be implemented to prevent this occurrence. It has been found that, in one form, a reverse bias of −100V is sufficient.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for delivering toner from a donor surface to a receiver surface, the method comprising steps of:

ejecting toner particles from the donor surface using an over-voltage condition based on using a momentarily high first electric field;

accelerating the ejected toner particles toward the receiver surface using a lower second electric field;

decelerating the ejected toner particles as the ejected toner particles approach the receiver surface;

returning undeveloped toner particles to the donor surface; and, decelerating undeveloped toner particles as the undeveloped toner particles approach the donor surface.

2. The method as set forth in claim 1 wherein the ejecting, accelerating, decelerating, returning and decelerating are controlled by a controller operative to produce an output waveform based on selected input parameters.

3. The method as set forth in claim 1 wherein the overvoltage condition is momentary.

4. The method as set forth in claim 1 wherein the overvoltage condition results in releasing a majority of the toner particles from the donor surface.

5. The method as set forth in claim 1 wherein the overvoltage condition is sufficient to overcome adhesion forces between the toner particles and the donor surface.

6. The method as set forth in claim 1 wherein the overvoltage condition is tuned based on a desired value for the accelerating.

7. The method as set forth in claim 1 wherein the decelerating minimizes impact of the undeveloped particles on the donor surface.

8. The method as set forth in claim 1 wherein the receiver surface is a photoreceptor.

9. The method as set forth in claim 1 further comprising providing a reverse background bias.

10. A system comprising:

a donor surface having toner particles disposed thereon;

a receiver surface operative to receive the toner particles; and, a controller operative to produce signals to control migration of the toner particles from the donor surface to the receiver surface wherein the donor particles are ejected from the donor surface using an overvoltage condition based on using a momentarily high first electric field, accelerated toward the receiver surface using a lower second electric field and decelerated as the ejected particles approach the receiver surface and further wherein undeveloped toner particles are returned to the donor surface and decelerated as the undeveloped toner particles approach the donor surface.

11. The system as set forth in claim 10 wherein the controller is operative to receive input signals.

12. The system as set forth in claim 11 wherein the input signals comprise q/m, d, p.

13. The system as set forth in claim 10 wherein the produced signals comprise a waveform.

14. The system as set forth in claim 13 further comprising a function generator operative to receive the waveform and produce signals to be output to a voltage amplifier.

15. The system as set forth in claim 10 further comprising a microscope operative to capture images on the receiver surface.

16. The system as set forth in claim 15 wherein the microscope provides feedback to the controller.

17. The system as set forth in claim 10 wherein the receiver surface is a photoreceptor.

* * * * *